US009134083B2

(12) United States Patent
Wasmer

(10) Patent No.: US 9,134,083 B2
(45) Date of Patent: Sep. 15, 2015

(54) HANDGUN

(75) Inventor: Edelbert Wasmer, Bernau-Innerlehen (DE)

(73) Assignee: Armatix Invest GmbH, Zürich (CH)

( * ) Notice: Subject to any disclaimer, the term of this patent is extended or adjusted under 35 U.S.C. 154(b) by 0 days.

(21) Appl. No.: 14/009,368

(22) PCT Filed: Mar. 30, 2012

(86) PCT No.: PCT/DE2012/000344

§ 371 (c)(1), (2), (4) Date: Oct. 2, 2013

(87) PCT Pub. No.: WO2012/136190

PCT Pub. Date: Oct. 11, 2012

(65) Prior Publication Data

US 2014/0020274 A1 Jan. 23, 2014

(30) Foreign Application Priority Data

Apr. 6, 2011 (DE) ..... 10 2011 016 242

(51) Int. Cl.
*F41A 17/06* (2006.01)

(52) U.S. Cl.
CPC ..... *F41A 17/06* (2013.01); *F41A 17/063* (2013.01)

(58) Field of Classification Search
CPC ..... F41A 17/06; F41A 17/063
USPC ..... 42/1.01, 70.01, 70.04, 70.05, 70.06, 42/70.08, 70.11
See application file for complete search history.

(56) References Cited

U.S. PATENT DOCUMENTS

| | | | | |
|---|---|---|---|---|
| 4,682,435 | A | 7/1987 | Heltzel | |
| 5,062,232 | A * | 11/1991 | Eppler | 42/70.11 |
| 5,448,847 | A * | 9/1995 | Teetzel | 42/70.11 |
| 5,465,518 | A | 11/1995 | Blaser | |
| 5,502,915 | A * | 4/1996 | Mendelsohn et al. | 42/70.11 |
| 5,915,936 | A * | 6/1999 | Brentzel | 42/70.11 |
| 6,370,806 | B1 * | 4/2002 | Klebes et al. | 42/84 |
| 6,442,880 | B1 * | 9/2002 | Allan | 42/70.08 |
| 6,499,243 | B1 * | 12/2002 | Herzog | 42/70.07 |
| 7,908,779 | B2 | 3/2011 | Wasmer | |
| 2002/0032976 | A1 | 3/2002 | Riener | |
| 2002/0178635 | A1 * | 12/2002 | Martin | 42/70.11 |
| 2003/0136043 | A1 * | 7/2003 | Lauster et al. | 42/70.11 |
| 2006/0242879 | A1 * | 11/2006 | Schmitter | 42/70.01 |
| 2007/0074438 | A1 * | 4/2007 | Parhofer et al. | 42/70.01 |
| 2009/0007476 | A1 * | 1/2009 | Mauch et al. | 42/1.01 |
| 2011/0002077 | A1 | 1/2011 | Brundula | |
| 2012/0180357 | A1 * | 7/2012 | Dietel et al. | 42/70.06 |

FOREIGN PATENT DOCUMENTS

| | | | |
|---|---|---|---|
| GB | 2 369 876 | A | 6/2002 |
| WO | 2005/005908 | A2 | 1/2005 |

* cited by examiner

*Primary Examiner* — Bret Hayes
(74) *Attorney, Agent, or Firm* — Gudrun E. Huckett

(57) ABSTRACT

According to the invention, a handgun has an electronic device with a timer. The timer defines a period of time. If the period of time has expired, the mechanical device for triggering the cartridge is mechanically blocked.

11 Claims, 1 Drawing Sheet

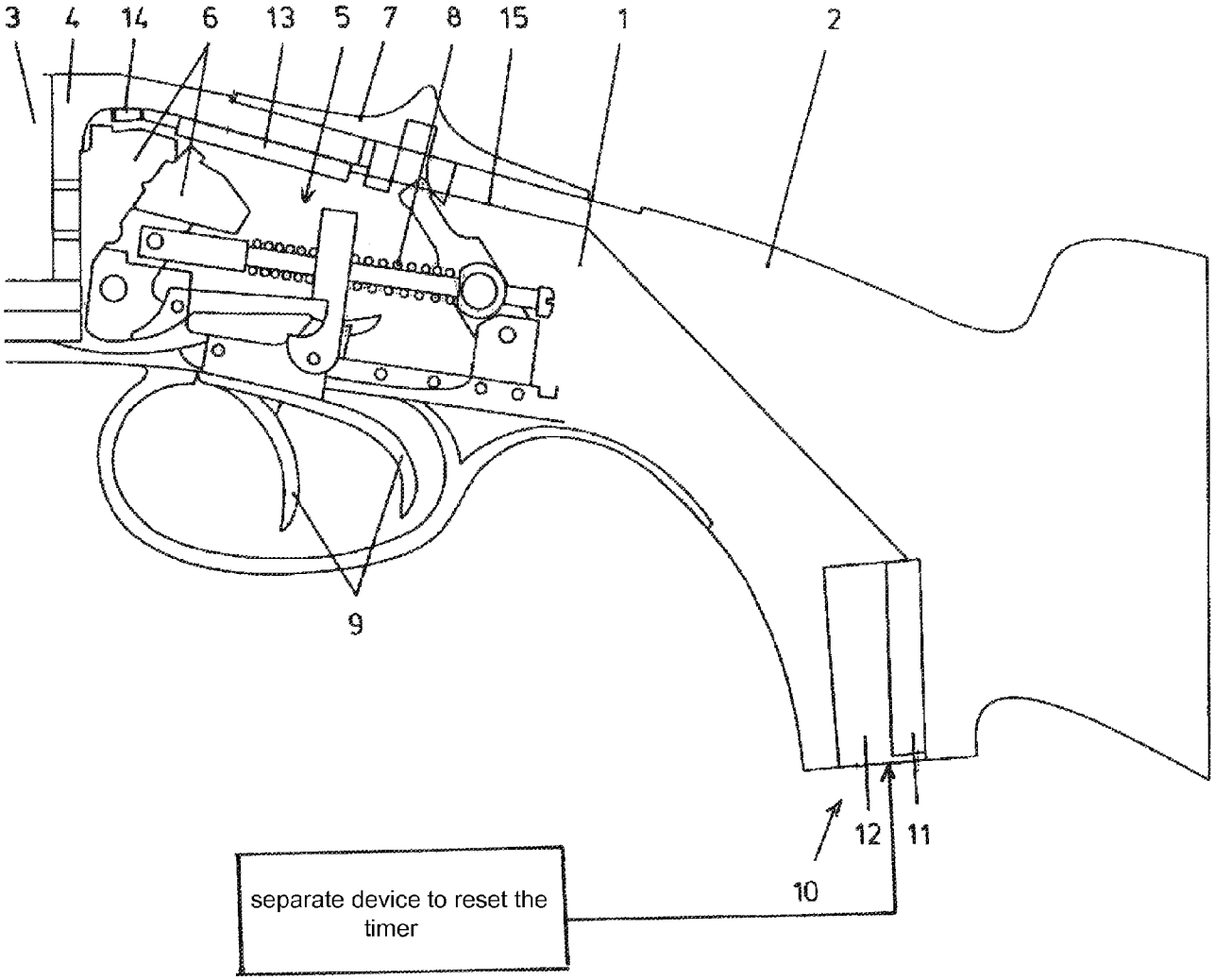
3
4
14
6
13
5
7
8
15
1
2
9
10
12
11
separate device to reset the timer

HANDGUN

BACKGROUND OF THE INVENTION

The invention concerns a safety system associated with a handgun comprising an electronic device with a timer.

The special field of application of the handgun according to the invention (short gun or long gun) concerns in particular sporting guns.

Handguns have in principle a barrel. Hunting rifles can have a total of four barrels.

At the rearward end of the barrel there is a cartridge chamber for receiving a cartridge. Each barrel has correlated therewith a lock. This lock has a hammer which is tensioned against the force of a spring. By actuating the trigger, the hammer can be released so that, as a result of the spring force, it will accelerate forwardly and actuate the firing pin and thus fire the cartridge. In addition to hand-actuated locks, there are also so-called self-cocking locks.

The problem with handguns is their safety or lack thereof with regard to improper, in particular, unauthorized use. For example, sporting guns are sometimes not used for months or even years. But they are still operative.

DE 44 13 685 A1 discloses a securing device for hunting and sporting guns of the aforementioned kind. For this purpose, a timing relay is provided which, by means of a reversing lever, for example, the safety lever of the gun, or by the cocking lever can be actuated. After the pre-adjusted time has elapsed, various safety and alert functions are triggered. For example, after the time period has elapsed, a decocking device may be actuated so that the weapon is set on safety or is decocked. Also, it is possible to provide a visual or acoustic signal after the time period has elapsed.

Based on this, the object of the invention is to provide a handgun of the aforementioned kind with improved safety.

SUMMARY OF THE INVENTION

The technical solution is characterized in that the timer of the electronic device can be reset to a temporal start position by means of a separate device that is independent of the handgun by a person exclusively authorized for this purpose, and, after the time period of the timer has elapsed, the operating function of the handgun is canceled and the handgun can no longer be actuated.

The basic idea of the handgun according to the invention resides in that it is provided with a time control. In this context, an appropriate timer is to be understood in the most general sense. Time control provides that the handgun is operative only for a predetermined fixed time period. In order to maintain this operative readiness past this predetermined time period, the timer of the electronic device must be reset to a temporal zero point position before the time period has elapsed. From this point on, the predetermined time period will start again. When, on the other hand, the temporal reset does not occur within this time period, the handgun will be transferred into its inoperative state. This is realized in that the mechanical device for firing the cartridge is blocked by an appropriate device. Of course, even after the blocking action of the gun has been activated, the gun can again be returned into the operative state with the above described process in that the timer is activated. Important in connection with this safety system is that the reset of the timer to the zero point position is done by a device that is independent of the gun and is realized by means of a person exclusively authorized for this purpose, in particular, by a gunsmith. The basic idea of the invention resides thus in that a handgun is to be made inoperative when it has not been used a certain period of time, i.e., in regular sporting activity the timer at the shooting range has not been returned to the temporal zero point position.

A clock is preferably provided as a timer. With this clock a certain time period can be exactly adjusted. This clock can be integrated into the electronic device or provided in a separate removable chip of this electronic device. In any case, this clock together with its electronic device is to be designed such that it cannot be manipulated by unauthorized persons.

As an alternative to the clock as a timer of the electronic device, the life span of an integrated battery can be used also. This is so because the electronic device requires electrical energy for its operation. After a certain time period, there is no longer sufficient energy contained in the battery. For example, the electrical energy can last for 6 to 7 months. This life span of the battery defines the pre-described time period. In order to reset the timer to its zero point position, the battery must be either exchanged or recharged in this special case with use of a battery.

A further safety aspect resides in that when the electronic device or a part of this electronic device is not in its operating position on or within the handgun, the electronic device will recognize this and activate the mechanical blocking device for the mechanical device for firing the cartridge. This can be the case, for example, when the removable chip of the electronic device is not in its operating position. In this context, it is also conceivable that in case of safety considerations the chip is simply confiscated so that the gun can no longer be actuated. Or in case of inherited handguns an appropriate device is installed but the chip is not released to the heirs. In this case, it is also conceivable likewise that the gun is no longer operative when the handgun is prepared in this way by an authorized gunsmith.

A first variant proposes that the electronic device is inseparably arranged in or on the handgun. This means that the gun on the shooting range must be handed over to the authorized person for newly adjusting the timer.

An alternative thereto proposes that at least a part of the electronic device is removable from the handgun and reinsertable. This can be preferably an electronic chip which is inserted into the actual electronic device. Here, it is then possible that the chip is removed from the gun in order to be able to realize by means of it the temporal zero point adjustment. For this purpose, the chip is inserted into an appropriate reading device. Time and location are then also determined therein.

In the state of blockage of the electronic device for firing the cartridge, a visual and/or acoustic signal is generated. This is the case when either the chip has not been inserted into the gun or when the prescribed time period has elapsed. This signal can be suppressed, as needed, on the shooting range.

A further preferred embodiment proposes a radio receiver. This radio receiver for this very special handgun can then influence the operating state of the handgun. When, for example, the handgun is in the hands of an unauthorized person, an appropriate radio signal can be emitted. The signal then blocks by means of the electronic device the mechanical device for firing the cartridge. This in and of itself represents an independent invention.

Finally, it is proposed that the handgun has a positioning system. This gun positioning system is basically embodied as a radio system with the exception that it operates bidirectionally and that primarily also positioning data are sent by the gun in order to transmit and to determine the geographic location and also, for example, the gun number or the number of the central register (and thus also the name of the owner). This represents in and of itself also an independent invention.

BRIEF DESCRIPTION OF THE DRAWINGS

One embodiment of a handgun according to the invention will be explained in the following with the aid of the drawing. This drawing shows a schematic longitudinal illustration of the weapon.

DESCRIPTION OF PREFERRED EMBODIMENTS

The gun has a housing 1 in which, in the drawing, to the right a stock 2 and to the left a cartridge chamber 3 with adjoining barrel are located. The cartridge chamber 3 is limited by a breech plate 4 in which the firing pin is located. Since the illustrated embodiment is a double-barreled rifle, a total of two cartridge chambers 3 are provided that are overlapped.

In the housing 1 there are two adjacently positioned cropped locks 5 each having a pivotably supported hammer 6. By actuation of the slide 7 on the top of the stock, by means of a lever mechanism, the respective hammer 6 can be cocked against the force of a spring 8 into the rearwardly pivoted cocked position in which the respective hammer 6 is positionally fixed. By actuation of one of two triggers 9, the respective correlated hammer 6 can be released so that, as a result of the force of the spring 8, it is accelerated forwardly in the direction of the breech plate 4 of the cartridge chamber 3 and actuates there the percussion cap of the cartridge.

In the stock area, an electronic device 10, namely comprised of an electronic unit 11 arranged fixedly within the stock 2 as well as an electronic chip 12 which is removable and insertable and in electric contact with the electronic unit 11.

Provided is moreover a positioning device 13. It is fixedly and inseparably connected with the gun. This positioning device 13 is based on the GPS system or another positioning system.

Finally, a movable locking part 14 is provided which interacts with the hammer 6.

The function is as follows:

The afore described electronic device 10 with its electronic unit 11 and its electronic chip 12 comprises a timer. The timer is integrated in the chip 12.

The gun is operative only when the chip 12 is in the inserted position and the timer of the chip 12 defines a time window within which operation of the gun is possible. For the permanent operativeness of the gun, the timer of the chip 12 must be reset from time to time temporally into a start position. This is possible only by means of an authorized person. By means of this temporal zero point, a time period is predetermined within which the gun is operative. When this time period has elapsed, the electronic device 10 will send a signal to the locking part 14 by means of a cable 15. The latter locks the mechanical device (no matter at which location) for firing the cartridge. Only when the timer of the chip 12 has been reset to its temporal zero position, the locking part 14 releases, and the gun is then operative again.

Accordingly, when, after the predetermined time period has elapsed, the timer of the chip 12 is not newly "reloaded" again, the operational function of the gun is canceled and can therefore also not be actuated anymore.

By means of the positioning device 13 the weapon can be located. Since it is a bidirectional radio system, by means of this positioning device 13 (but also by a radio device of its own) the electronic device 10 can be acted on such that by means of the radio signal the locking device 14 is actuated and therefore the gun is locked. A locating action by means of the positioning device 13 is then still possible.

LIST OF REFERENCE NUMERALS

1 housing
2 stock
3 cartridge chamber
4 breech plate
5 lock
6 hammer
7 slide
8 spring
9 trigger
10 electronic device
11 electronic unit
12 electronic chip
13 positioning device
14 locking part
15 cable

What is claimed is:

1. A safety system comprising:

a handgun and a separate device that is independent of the handgun;

wherein the handgun comprises:

a barrel having a rearward end and a forward end;

a cartridge chamber arranged at the rearward end of the barrel;

a mechanical device configured to fire a cartridge from the cartridge chamber;

an electronic device with a timer, wherein the timer of the electronic device is configured to be set to a predetermined time period during which the handgun is in an operative state and is further configured to be reset to a temporal start position to restart the predetermined time period, wherein, when the predetermined time period has elapsed and the timer has not been reset, the electronic device causes the handgun to become inoperative so that the handgun can no longer be actuated;

wherein the separate device that is independent of the handgun is in care of a person exclusively authorized to handle the separate device to reset the timer, wherein the separate device resets the timer of the electronic device to the temporal start position when acted on by said exclusively authorized person to return the handgun to the operative state.

2. The safety system according to claim 1, wherein the timer is a clock.

3. The safety system according to claim 1, wherein the electronic device has a battery and wherein an available electrical energy of the battery is provided as the timer.

4. The safety system according to claim 1, wherein the electronic device is arranged in a local operating position on the handgun or in the handgun.

5. The safety system according to claim 4, wherein mechanical blocking of the mechanical device is realized when the electronic device is not in the local operating position on the hand gun or in the handgun.

6. The safety system according to claim 5, wherein a visual and/or acoustic signal is generated when mechanical blocking occurs.

7. The safety system according to claim 1, wherein the electronic device, after the predetermined time period has elapsed, causes mechanical blocking of the mechanical device configured to fire the cartridge.

8. The safety system according to claim 7, wherein a visual and/or acoustic signal is generated when mechanical blocking occurs.

9. The safety system according to claim 1, wherein a radio receiver is provided by means of which the electronic device is transferred wireless into a state causing mechanical blocking of the mechanical device configured to fire the cartridge.

10. The safety system according to claim 1, wherein at least a part of the electronic device is configured to be removed from the handgun and reinserted again.

11. The safety system according to claim 1, comprising a positioning device.

* * * * *